United States Patent [19]

Åberg

[11] 4,424,752

[45] Jan. 10, 1984

[54] LOADING PALLET

[75] Inventor: Seard Åberg, Gammelstad, Sweden

[73] Assignee: Groko Maskin AB, Lulea, Sweden

[21] Appl. No.: 279,966

[22] PCT Filed: Oct. 30, 1980

[86] PCT No.: PCT/SE80/00267

§ 371 Date: Jun. 29, 1981

§ 102(e) Date: Jun. 29, 1981

[87] PCT Pub. No.: WO81/01279

PCT Pub. Date: May 14, 1981

[30] Foreign Application Priority Data

Oct. 30, 1979 [SE] Sweden ..... 7908975

[51] Int. Cl.[3] ..... B65D 19/28

[52] U.S. Cl. ..... 108/51.1

[58] Field of Search ..... 108/51.1, 53.1, 53.3, 108/56.1, 57.1; 206/599, 600, 386

[56] References Cited

U.S. PATENT DOCUMENTS

| | | | |
|---|---|---|---|
| 1,508,898 | 9/1924 | Smith | 108/51.1 |
| 1,612,382 | 12/1926 | Lehman | 108/51.1 |
| 2,123,714 | 7/1938 | Clark | 108/51.1 |
| 2,544,743 | 3/1951 | Vrabcak | 108/52.1 X |
| 2,615,661 | 10/1952 | Cushman | 108/53.3 |
| 4,326,467 | 4/1982 | Schleicher et al. | 108/56.1 |

FOREIGN PATENT DOCUMENTS

| | | | |
|---|---|---|---|
| 1144646 | 3/1969 | United Kingdom | 108/51.1 |
| 1246854 | 9/1971 | United Kingdom | 108/51.1 |

*Primary Examiner*—William E. Lyddane

*Attorney, Agent, or Firm*—Kenyon & Kenyon

[57] ABSTRACT

This invention relates to a loading pallet. Conventional pallets of wood show deficiencies with respect to durability and service life. In order to eliminate these deficiencies and also other ones involved with conventional wood pallets, according to the present invention a pallet with a load-carrying platform of corrugated sheet metal is proposed, which platform (3) is supported at its opposed edges by supporting beams (4) of substantially U-shaped cross-section, which beams extend perpendicularly to the corrugations (2) and are formed integral with the platform by folding the metal sheet three times substantially perpendicularly, so that its free end portions (10) form the inside of the respective supporting beam and constitute supporting legs for the platform spaced from the outer edges thereof, and said end portions (10) are locked relative to the platform in a substantially vertical position and have between themselves a free space beneath the platform which permits the insertion of the lift forks of a truck from one side or the other.

8 Claims, 5 Drawing Figures

LOADING PALLET

This invention generally relates to a loading pallet and it refers, more precisely, to a pallet of sheet metal and to a method of manufacturing the same.

Conventional pallets most often consist of a low-height structure of platform type, which is assembled of lumber by nailing, and in the side walls of which recesses are provided to be engaged by the lift-fork of a fork-truck. In spite of the deficiencies which this structure shows with respect to durability and service life, so far no pallet structure has been developed which suitably can replace and/or complete the wooden pallet.

In view of the strongly increasing wood price and the deterioration in wood quality, resulting in more expensive pallets of poorer quality and shorter service life, the demand for an improved pallet lately has increased. The object of the present invention is to meet this demand and to produce a pallet, which has at least as light a weight and is as durable as the wooden pallet, but is cheaper to manufacture and more hygienic than a pallet of wood, so that it can be applied even in the foodstuffs industry and in food distribution. In other respects, the pallet shall have all advantages of the wooden conventional pallet.

This object is achieved in that the pallet according to the present invention has been given the characterizing features defined in the attached claims. For manufacturing the pallet according to the invention in a simple and rational way, the invention also proposes a method with the features defined in the claims.

Figure 1:
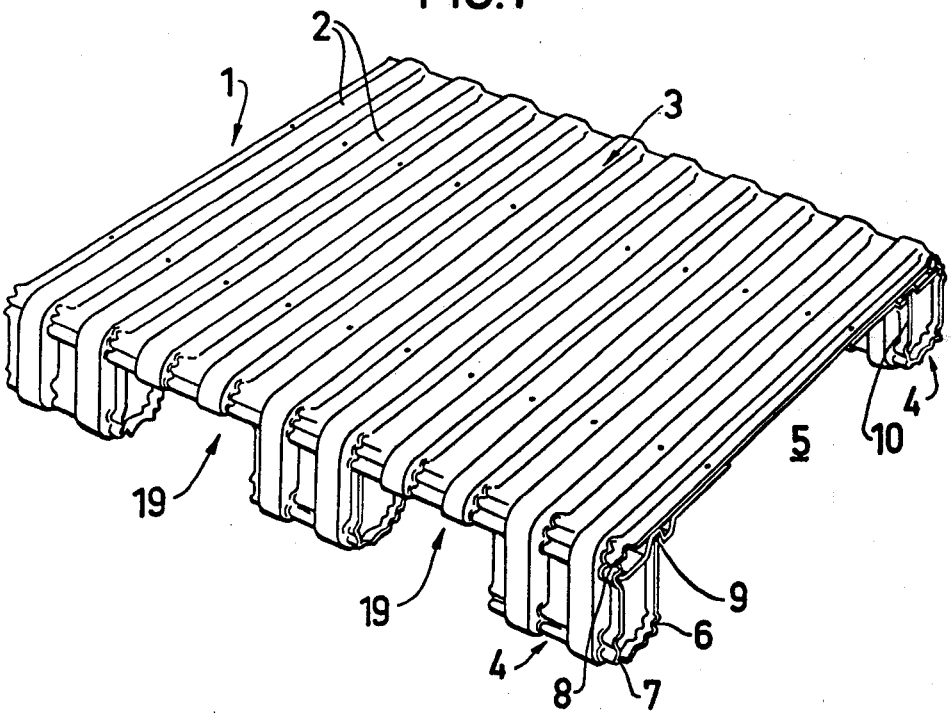
Figure 2:
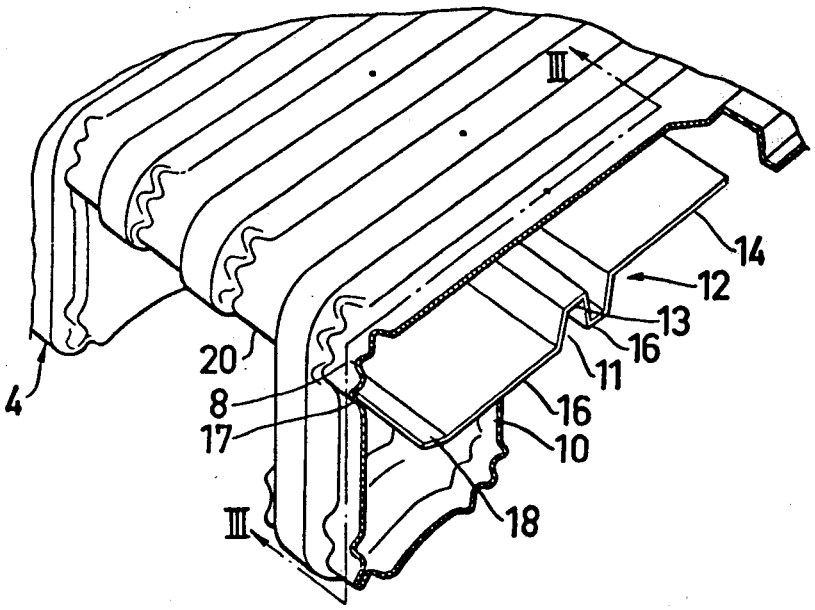
Figure 3:
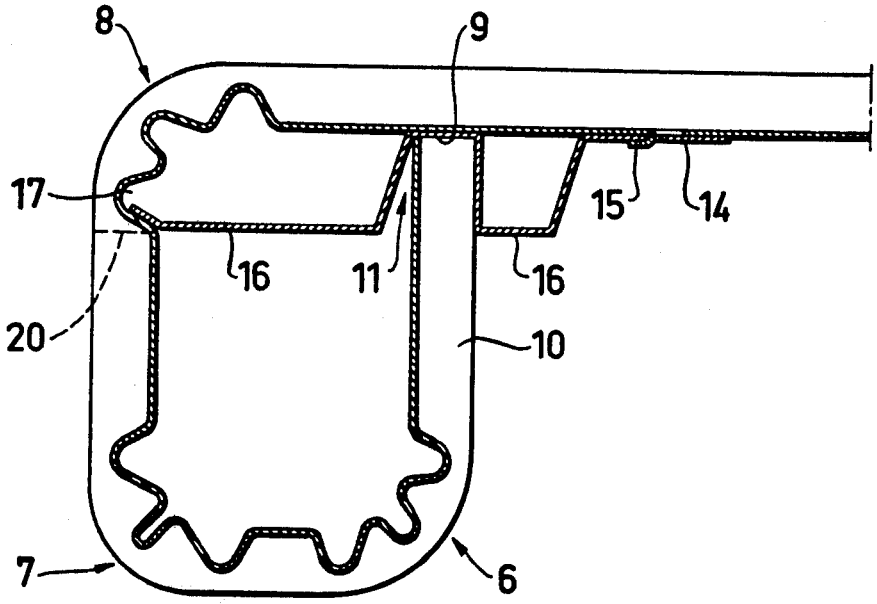
Figure 4:
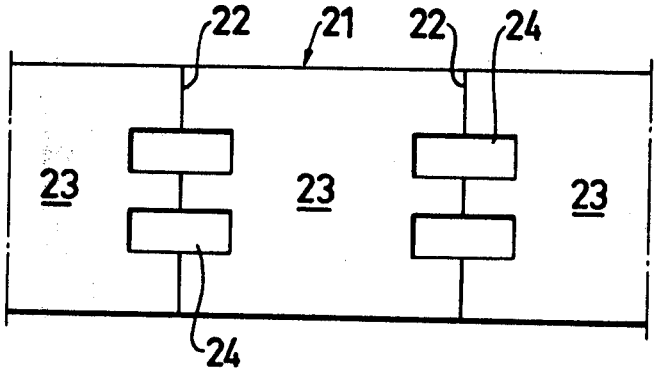
Figure 5:
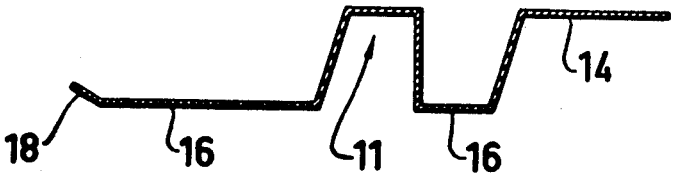

The invention is described in greater detail in the following, with reference to the accompanying drawings, in which FIG. 1 is a perspective view of a preferred embodiment of the pallet according to the invention, FIG. 2 is a perspective and cross-sectional view of a pallet detail, FIG. 3 is a vertical section along substantially the line III—III in FIG. 2, FIG. 4 is a view from above of a metal sheet for manufacturing a pallet according to the invention, and FIG. 5 is a section through a lifting bar comprised in the pallet.

The pallet according to the present invention comprises a metal sheet 1 with preferably trapezoid corrugations 2. The sheet 1 constitutes a platform 3 acting as a carrying plane, which is supported on box-shaped or, more correctly, U-shaped support or carrying beams 4, which extend perpendicularly relative to the sheet corrugations and between themselves form a free space 5 beneath the platform 3, into which space the fork of a loader can be inserted from one side or the other.

Each of the supporting beams 4 is formed of the same sheet metal blank as the platform, in such a manner, that a corrugated sheet metal blank cut to desired length is bent in three suitably spaced places so that corners 6, 7 and 8 are obtained. The distance between the corners 6 and 7 determining the beam width can be varied for obtaining supporting beams 4 of a greater or smaller width, but the distance between the corners 7 and 8, of course, shall be substantially the same as the distance between the corner 6 and the free end 9 of the sheet, so that the end portion 10 constituting the inner surface of the beam abuts the lower surface of the platform by said end 9 and acts as a supporting leg for the platform, thereby increasing the bearing capacity thereof.

Each such end portion 10 is inserted with its free end 9 into a locking groove 11 extending perpendicularly to the corrugations 2, and by said groove 11 the respective end portion 10 is fixed and locked relative to the platform in a vertical positon, as clearly appears from FIG. 3. The locking grooves 11 are formed each in a lifting bar 12, which extends across the entire width of the pallet and at the same level as the locking groove bottom 13 is provided with an attachment strip 14, which like the locking groove bottom abuts the lower surface of the platform and is connected thereto by pop rivets or by bent-over locking tips 15, which are punched out of the attachment strip 14, possibly also of the locking groove bottom 13, and of the platform, as shown schematically in FIG. 3. Each lifting bar 12 has carrying surfaces 16 on both sides of the locking groove 11, one of which surfaces spreads all the way to the corner 8 and into a fold 17 formed at the bending operation in each corrugation 2. Said fold has a slightly upward folded edge portion 18, which thus locks and fixes the lifting bar in said fold 17.

In each supporting beam 4 two spaced and downwardly open recesses 19 are formed to the same level as the carrying surfaces 16 of the lifting bars, which recesses permit insertion of the loader fork also from this side of the pallet. The embodiment shown in FIG. 1 thereby is a so-called four-way pallet.

The pallet when supported on lift forks inserted through the recesses 19 rests against the forks by the carrying surfaces 16 of the lift bars. The load thereby is distributed over a large area, which is advantageous from a strength point of view. The pallet to some extent also rests against the upper defining surfaces 20 of the recesses in the outer lateral surfaces of the supporting beams, which surfaces 20 as already mentioned are located at the same level as the carrying surfaces 16 of the lift bars. The same load distribution also is brought about by the attachment strips 14 of the lift bars of lift forks inserted between the supporting beams, when the strips are given sufficient width, which however is not required from a strenght point of view.

The starting material for the manufacture of pallets according to the invention can be smooth metal sheets of great length. In FIG. 4 such a sheet 21 is shown by fully drawn transverse lines 22, which indicate the separation line between two sheet blanks 23. Transversely across each such line 22 rectangular openings 24 are punched out in the sheet 21, which openings extend equally long on both sides of the line 22 and form recesses 19 in the supporting beams 4 of the respective pallet. When said openings have been punched out, the sheet blanks are separated along the lines 22, and each such sheet blank is fed into a section rolling mill where the blanks are corrugated, rolled to desired cross-sectional shape and edged, i.e. the longitudinal outer edges of the blanks are folded first 90° to form the surfaces 20, then further folded 90° to form the corners 7 and finally 90° to form the corners 6, leaving the end portion 10 upstanding. Such folding or bending is possible by using the principals of the Naslund U.S. Pat. No. 4,220,031, as can be seen from the folds 17 and the corresponding adjacent folds. The sheet blanks, of course, also can be separated subsequent to the rolling mill. After said section rolling, every sheet blank is bent at its transverse edge portions in a bending machine, whereby the supporting beams 4 are formed, and the lift bars are inserted into position and secured. The lift bars 12 can be pressed to the cross-sectional shape as desired and as shown in FIG. 5 from the same starting material as for the pallets. For this purpose also the sheet pieces can be used, which were obtained at the punching operation for the openings 24 and which at the embodiment shown have a length corresponding substantially to half the width of the completed pallet. In other words, two lift bars formed of these sheet pieces for each supporting beam fall away.

The present invention, thus, has brought about a sheet metal pallet, which in spite of its low weight has extraordinary bearing capacity, very good strength and long service life, and which can be manufactured in a simple and rational way. The pallet material being sheet metal, it also can easily be cleaned and disinfected.

The present invention is not restricted to the embodiment described above, but can be altered, modified and completed in many different ways within the scope of the invention idea defined in the attached claims.

I claim:

1. A loading pallet having a load-carrying platform of corrugated sheet metal, characterized in that the platform (3) is supported at its opposed edges by supporting beams (4) of substantially U-shaped cross-section and extending perpendicularly to the corrugations (2), which beams are formed integral with the platform by bending the sheet three times substantially at right angle, so that its free end portions (10) form the inner surface of the respective supporting beam and constitute supporting legs for the platform spaced from the outer edges thereof, and said end portions (10) are locked relative to the platform in a substantially vertical position and have between themselves a free space beneath the platform to permit insertion of the forks of a loader from one side or the other, and each supporting beam (4) is provided with spaced downwardly open recesses (19), which permit insertion of the forks of a loader also from these sides of the pallet, said platform and said beams being all formed from said corrugated sheet metal with a plurality of its full corrugations extending contiguously and integrally throughout the platform and beams.

2. A pallet as defined in claim 1, characterized in that each of the free end portions (10) for its locking relative to the platform (3) is inserted with its end into a locking groove (11) provided in a bar (12) at the lower surface of the platform and extending perpendicularly to the corrugations.

3. A pallet as defined in claim 2, characterized in that each such bar (12) has depending carrying surfaces (16).

4. A pallet as defined in claim 3, characterized in that such carrying surfaces (16) are formed on both sides of the locking groove (11) of each bar.

5. A pallet as defined in claim 2, characterized in that each bar (12) has a flat member (14) aligning with the bottom of the locking groove, by which member and the locking groove bottom the bar rests against the lower surface of the platform and is connected to the same by locking tips (15), which are bent over and punched out in the flat member and in the bottom of the locking groove and in the platform.

6. A pallet as defined claim 2, characterized in that each bar (12) is fixed with its longitudinal edge remote from the attachment member in folds in the corrugation formed at the bending operation at the perpendicular transition between the platform and the supporting beam.

7. A method for manufacturing a pallet of sheet metal as defined in claim 1, characterized in that metal sheet openings (24) are punched to form recesses (19) of the supporting beams, and that the corrugated metal sheet first thereafter is bent at right angle to the corrugations at its edges to form the supporting beams (4) integral with the platform (3).

8. A method as defined in claim 7, characterized in that the metal sheet is corrugated after the punching of said openings (24) and cut to desired lengths.

* * * * *